US009192528B1

(12) United States Patent
Ling

(10) Patent No.: US 9,192,528 B1
(45) Date of Patent: Nov. 24, 2015

(54) FOLDABLE STRETCHER TROLLEY

(71) Applicant: Yen Wu Ling, Singapore (SG)

(72) Inventor: Yen Wu Ling, Singapore (SG)

( * ) Notice: Subject to any disclaimer, the term of this patent is extended or adjusted under 35 U.S.C. 154(b) by 0 days.

(21) Appl. No.: 14/529,655

(22) Filed: Oct. 31, 2014

Related U.S. Application Data

(60) Provisional application No. 62/004,331, filed on May 29, 2014.

(51) Int. Cl.

| | |
|---|---|
| ***B62B 3/02*** | (2006.01) |
| ***B62B 3/04*** | (2006.01) |
| ***A61G 1/013*** | (2006.01) |
| ***A61G 1/02*** | (2006.01) |

(52) U.S. Cl.
CPC ..... *A61G 1/013* (2013.01); *A61G 1/0237* (2013.01); *A61G 1/0293* (2013.01)

(58) Field of Classification Search
CPC ..... B62B 3/02; B62B 3/022; B62B 3/025; B62B 3/04; B62B 3/10; B62B 1/10; B62B 1/12; B62B 1/125; B62B 1/14; B62B 1/142; B62B 1/26; A61G 7/00; A61G 7/08; A61G 1/00; A61G 1/013; A61G 1/02; A61G 1/0293; A61G 1/06
USPC ..... 280/639, 640, 651, 657, 47.131, 47.18; 5/620, 625, 626, 627
See application file for complete search history.

(56) References Cited

U.S. PATENT DOCUMENTS

| | | | | |
|---|---|---|---|---|
| 1,483,607 | A * | 2/1924 | Liedtke | 296/20 |
| 3,782,749 | A * | 1/1974 | Wiczer | 280/641 |
| 5,634,221 | A * | 6/1997 | McKinney | 5/620 |
| 7,044,496 | B2 * | 5/2006 | Holmes | 280/639 |
| 8,419,046 | B2 * | 4/2013 | Limontini | 280/640 |
| 8,505,959 | B2 * | 8/2013 | Darling, III | 280/651 |

* cited by examiner

*Primary Examiner* — John Walters
(74) *Attorney, Agent, or Firm* — Nelson Mullins Riley & Scarborough, LLP

(57) ABSTRACT

A foldable trolley for supporting a stretcher, including a foldable frame having a pair of vertical support members that are rigidly secured to each other by a first horizontal member, and a pair of elongated frame members that are pivotally secured to the pair of vertical support members at their respective bottom ends and rigidly connected by a second horizontal member, a wheel assembly including a first wheel and a second wheel rotatably attached to a corresponding vertical support member, and a plurality of clamp assemblies, each clamp assembly being mounted to a top end of each vertical support member and each elongated frame members, each clamp assembly being movable between a closed position and an open position.

18 Claims, 20 Drawing Sheets

FOLDABLE STRETCHER TROLLEY

FIELD OF THE INVENTION

The present invention relates generally to a trolley for supporting a stretcher. More particularly, the present invention relates to a trolley that is foldable when not in use to facilitate transfer and storage thereof.

BACKGROUND OF THE INVENTION

Stretcher trolleys for transporting ambulatory patients from the scene of an accident to a treatment facility, mode of transportation, etc., are well known. Often, these trolleys are foldable so that they may be more readily stored when not in use, as they are often stored in ambulances and other emergency response vehicles where space can be rather limited. However, the articulated frames, that are required to allow the trolleys to be foldable, of certain prior art trolleys may limit the overall weight capacity of the trolley. For example, in those trolleys where slanted front and rear frame members meet in a symmetrical V-shaped configuration, high stress is exerted on the pivoting joint that connects slanted members, or the slanted members are urged outwardly away from each other by the weight of the person being supported. Additionally, the slanted frame members join the supported stretcher at acute internal angles and, as such, they do not directly support the vertical weight component of the stretcher and patient. Rather, a large portion of the weight is transferred along the slanted members to their pivoting joint. Moreover, many of these trolleys may require deployable support assemblies at both ends as the trolley is prone to tipping both forwardly and rearwardly when not being supported by the emergency response personnel.

The present invention recognizes and addresses considerations of prior art constructions and methods.

SUMMARY OF THE INVENTION

One embodiment of a foldable stretcher trolley in accordance with the present disclosure includes a foldable frame having a pair of vertical support members that are rigidly secured to each other by a first horizontal member, and a pair of elongated frame members that are pivotally secured to the pair of vertical support members at their respective bottom ends and rigidly connected by a second horizontal member, a wheel assembly including a first wheel and a second wheel rotatably attached to a corresponding vertical support member, and a plurality of clamp assemblies, each clamp assembly being mounted to a top end of each vertical support member and each elongated frame member, each clamp assembly being movable between a closed position to engage the stretcher and an open position to disengage the stretcher. The foldable frame is adjustable between an in-use position in which the pair of elongated frame members extend both rearwardly and upwardly from the bottom ends of the vertical support members, thereby forming an acute angle therebetween, to a stored position in which the pair of elongated frame members is substantially parallel to the pair of vertical support members.

Another embodiment of a foldable stretcher trolley and stretcher assembly in accordance with the present disclosure includes a stretcher including a pair of side rails and a support surface extending therebetween, a foldable frame including a pair of vertical support members that are rigidly secured to each other by a first horizontal member, and a pair of elongated frame members that are pivotally secured to the pair of vertical support members at their respective bottom ends and rigidly connected by a second horizontal member; a wheel assembly including a first wheel and a second wheel rotatably attached to a corresponding vertical support member; and a plurality of clamp assemblies, each clamp assembly being mounted to a top end of each vertical support member and each elongated frame members, each clamp assembly being movable between a closed position to engage the stretcher and an open position to disengage the stretcher. The foldable frame is adjustable between an in-use position in which the pair of elongated frame members form an acute angle with the vertical support members, to a stored position in which the pair of elongated frame members is substantially parallel to the pair of vertical support members, and the vertical support members are transverse to the corresponding side rails of the stretcher when the stretcher is secured to the foldable frame by the plurality of clamp assemblies.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
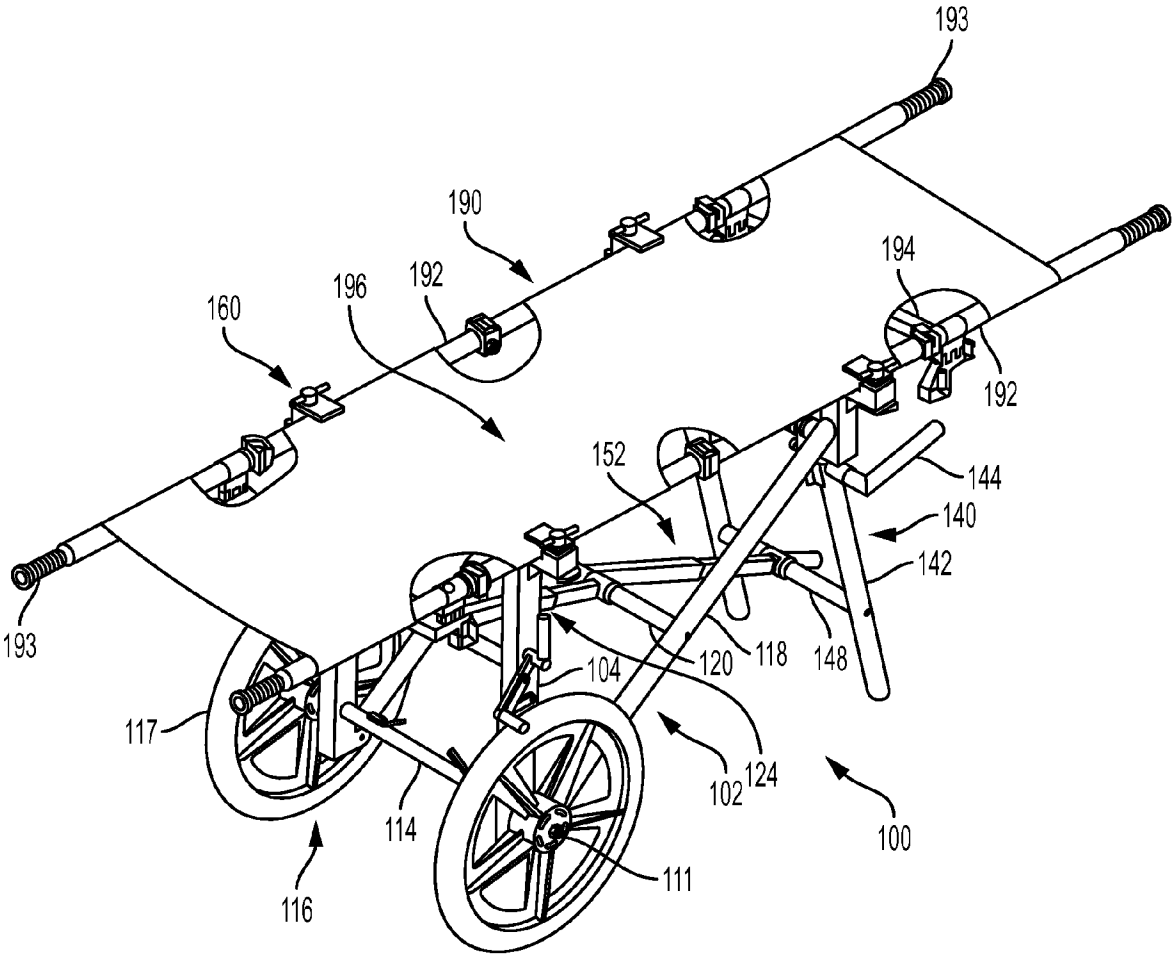
FIG. 1 is a perspective view of a foldable stretcher trolley in accordance with an embodiment of the present disclosure, wherein the stretcher trolley is supporting a stretcher.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2A:
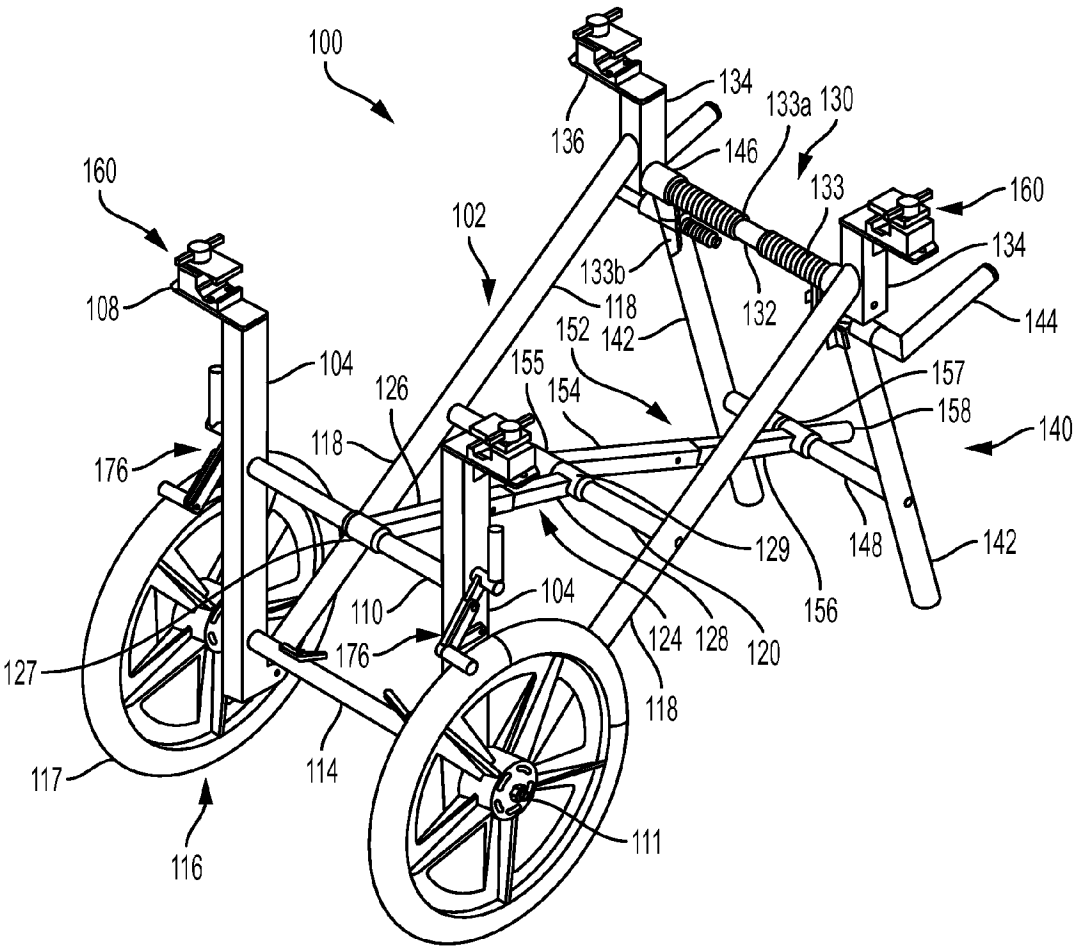
FIGS. 2A and 2B are perspective views of the foldable stretcher trolley shown in FIG. 1.
Figure 2B:
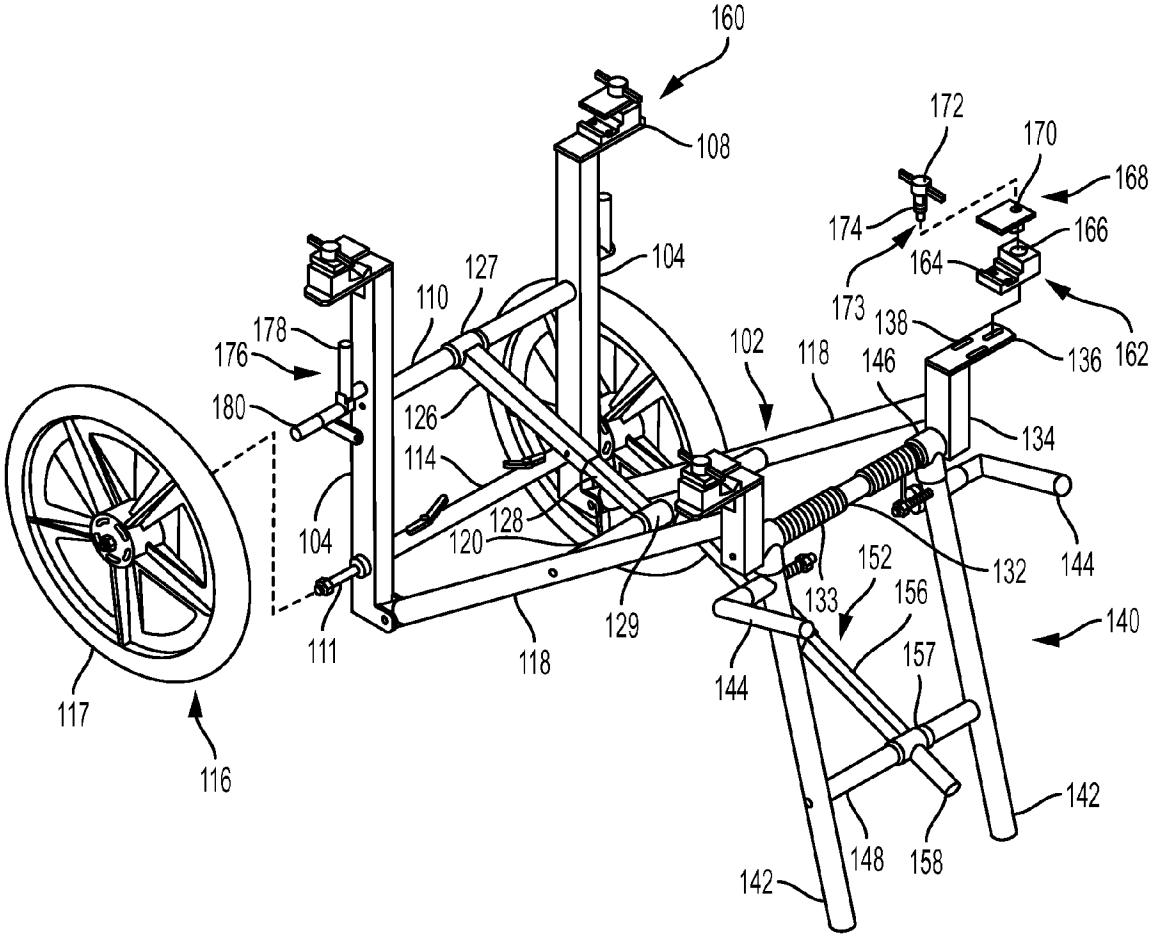

Referring now to FIGS. 1, 2A, 2B and 3, an embodiment of a foldable stretcher trolley 100 in accordance with the present disclosure includes a foldable frame 102, a leg assembly 140 pivotally attached thereto, a pair of wheels 116 and a plurality of clamp assemblies 160. As best seen in FIGS. 2A and 2B, foldable frame 102 includes a pair of vertical support members 104 that are rigidly connected by a first horizontal member 110 and an axle tube 114. Axle tube 114 extends between the lower portions of vertical support members 104 whereas first horizontal member 110 connects the central portions of vertical support members 104. An axle 111 is rotatably received in axle tube 114 and rotatably supports a wheel 116 at each end. Preferably, each wheel includes a pneumatic tire 117, although tires made of other materials, such as solid rubber, nylon, etc., may be used in alternate embodiments. A pair of elongated frame members 118 extends upwardly at an angle from the bottommost portions of vertical support members 104. The lowermost ends of frame members 118 are pivotally secured to the lowermost ends of vertical support members 104, so that frame members 118 may be folded relative to vertical support members 104. The uppermost portions of frame members 118 are rigidly connected by a base member 130. Additionally, a second horizontal member 120 rigidly connects the central portions of frame members 118.

Figure 3:
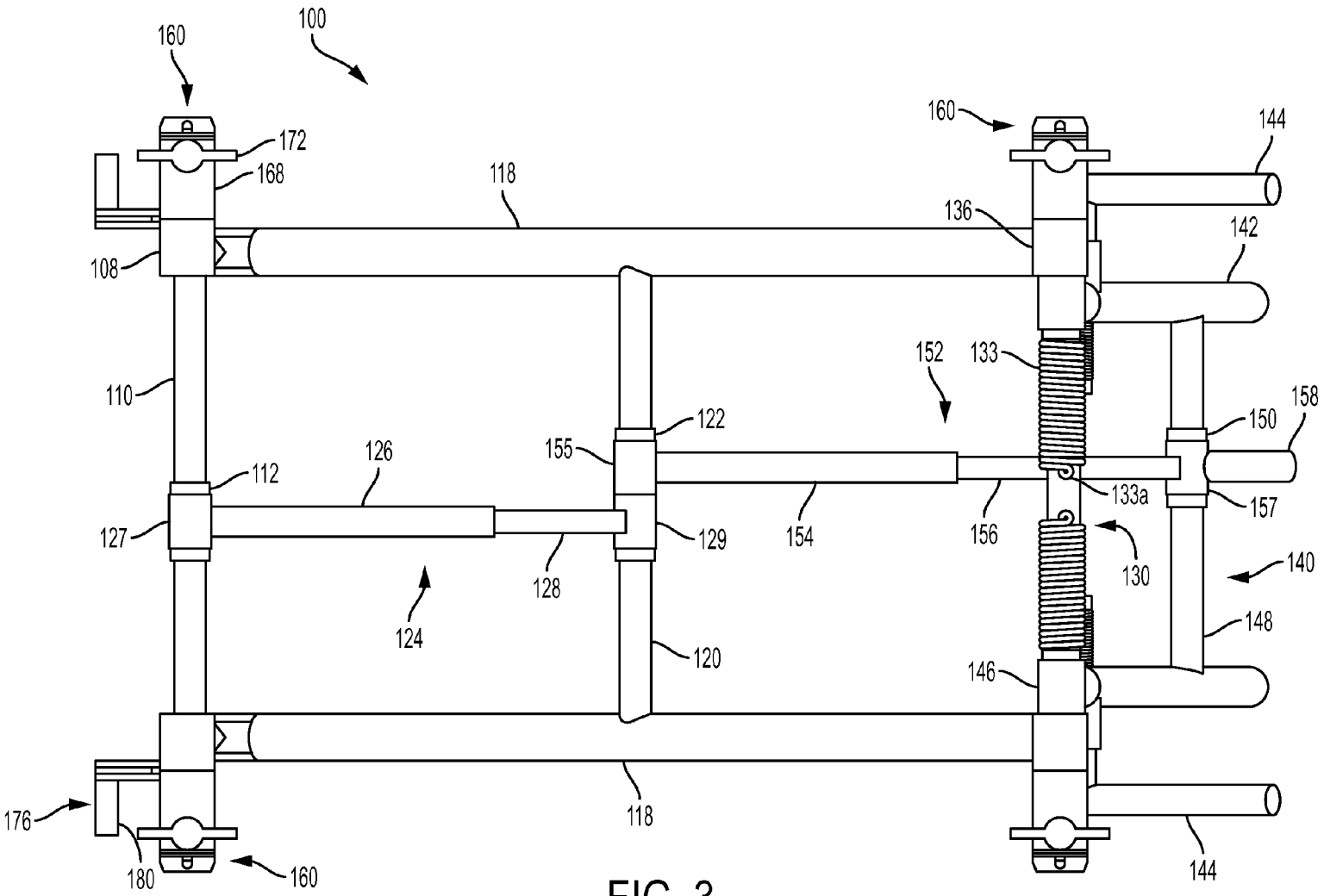
FIG. 3 is a top view of the foldable stretcher trolley shown in FIG. 1 with the wheels removed.

As best seen in FIG. 3, the central portions of first horizontal member 110 and second horizontal member 120 are connected by a first folding strut 124 that includes a first member 126 that is pivotally secured to first horizontal member 110 and a second member 128 that is pivotally secured to second horizontal member 120. The proximal ends of first member 126 and second member 128 of first folding strut 124 each include a sleeve 127 and 129, respectively, that is rotatably received about the corresponding first horizontal member 110 and second horizontal member 120, respectively. Sleeve 127 of first member 126 is axially maintained on first horizontal member 110 by a pair of collars 112 between which it is disposed. Similarly, sleeve 129 of second member 128 is maintained in the desired axial position by a pair of collars 122 that are disposed on second horizontal member 120. The distal ends of first member 126 and second member 128 of first folding strut 124 are pivotally secured to each other so that frame members 118 may be folded relative to vertical support members 104, as discussed in greater detail below.

As best seen in FIG. 2B, base member 130 includes a third horizontal member 132 that extends between a pair of vertical supports 134, each vertical support 134 being fixed to the uppermost end of a corresponding frame member 118, thereby rigidly securing the uppermost ends of frame members 118. A horizontally extending plate 136 is disposed at the top of each vertical support 134, each horizontal plate 136 defining a plurality of slots 138 there configured to adjustably receive a corresponding clamp assembly 160. Similarly, a pair of horizontal plates 108 are disposed on the top of vertical members 104, and are similarly configured to adjustably receive clamp assemblies 160. As shown, each claim assembly 160 includes a base plate 162 that is secured to a corresponding horizontal plate 136 by a plurality of fasteners (now shown). Slots 138 of each horizontal plate 136 are substantially transverse to a longitudinal center axis of foldable stretcher trolley, allowing each base member 130 to be adjusted relative to the longitudinal center axis in a transverse direction. As such, clamp assemblies 160 allow stretcher trolley 100 to be used with stretchers 190 (FIG. 1) of varying widths.

Further, each clamp assembly 160 includes a top plate 168 that is removably secured to the corresponding base plate 162 by a wing bolt 172. Each wing bolt 172 includes a threaded stem 173 that is received in corresponding bores 166 and 170 of base plate 162 and top plate 168, respectively. Bore 166 of base plate is correspondingly threaded to the threaded stem of the wing bolt, whereas bore 170 of top plate 168 is a smooth cylindrical surface. As such, top plate 168 is free to both rotate and slide axially along threaded stem 173 of the corresponding wing bolt 172 even though the wing bolt is threadedly received in base plate 162. A coiled spring 174, disposed about the threaded stem 174 as shown, is received in bores 166 and 170 of the base plate and the top plate, each spring 173 exerting an upward biasing force on the corresponding top plate 168. As such, when threaded stem 173 of wing bolt 172 is not fully engaged with threaded bore 166 of the corresponding base plate 162, coil spring 173 urges top plate 168 upwardly away from base plate 162 so that a side rail 192 of a corresponding stretcher 190 can be readily positioned therebetween, as shown in FIG. 1. With side rail 192 so positioned, a user rotates wing bolt 172 in the tightening direction until the side rail is firmly secured between top plate 168 and a groove 164 that is defined by base plate 162. To release the side rail of the stretcher, the user rotates wing bolt 172 in the loosening direction, thereby allowing coil spring 173 to urge top plate 168 upwardly away from base plate 162, where it can be rotated out of the way. Note, wing bolt 172 is preferably still engaged with threaded bore 166 when removing a stretcher so that the upper plate remains connected to the clamp assembly.

As previously noted, leg assembly 140 is pivotally secured to foldable frame 102. Specifically, leg assembly 140 includes a pair of legs 142, the proximal ends of which include sleeves 146 that are rotatably received about third horizontal member 132 of base member 130. A fourth horizontal member 148 extends between legs 142 of the leg assembly, thereby rigidly securing the legs to each other. Further, each leg 142 is secured by a corresponding torsion spring 133 to third horizontal member 132. Each torsion spring 133 is disposed about third horizontal member 132 and includes a first end 133*a* that is fixed to third horizontal member 132 and a second end 133*b* that is fixed to the corresponding leg 142, as best seen in FIG. 2A. Each torsion spring 133 is configured to bias the corresponding leg 142 inwardly toward a corresponding frame member 118 during folding operations of stretcher trolley 100, as discussed in greater detail below. As such, when deploying leg assembly 140 to the in-use position shown in FIG. 1, the inward biasing force of torsion springs 133 must be overcome by the user. A handle 144 is provided on each leg to facilitate the user in deploying leg assembly 140.

Leg assembly 140 is further connected to foldable frame 102 by a second folding strut 152 that includes a first member 154 and a second member 156. First member 154 and second member 156 each include a corresponding sleeve 155 and 157, respectively, the sleeve being rotatably received about second horizontal member 120 and fourth horizontal member 148, respectively. The distal ends of first member 154 and second member 156 of second folding strut 152 are pivotally secured to each other so that leg assembly 140 may be folded into the stored position (FIG. 4B) when desired. A foot actuator 158 extends radially outwardly from sleeve 157 of second member 156 so that a user may exert downward force on foot actuator 158, thereby causing the distal ends of first member 154 and second member 156 to pivot upwardly with respect to each other when moving leg assembly 142 to the restored position.

Figure 4A:
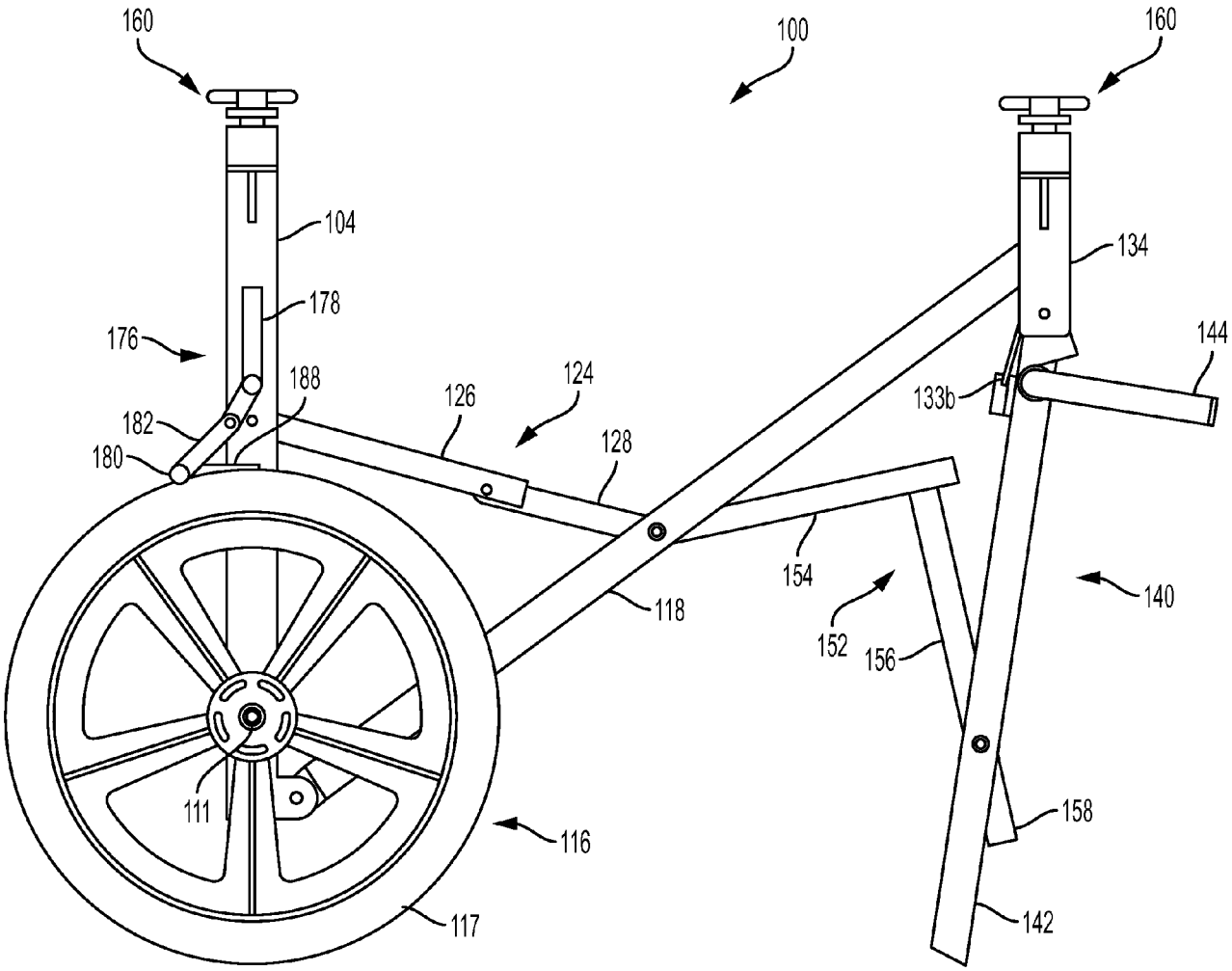
FIGS. 4A through 4D are side views of the foldable stretcher trolley shown in FIG. 1, being folded to facilitate storage of the foldable stretcher trolley.

As best seen in FIG. 2B, a wheel brake assembly 176 is secured to each vertical member 104 adjacent a corresponding wheel 116. Each wheel brake assembly 176 includes a handle portion 178 and an engagement portion 180 that are pivotally secured to each other by means of a first linkage member 182 and a second linkage member 188 (FIG. 4A). As shown in FIG. 4A, wheel brake assembly 176 is in the engaged position. To disengage wheel brake assembly 176, a user rotates handle portion 178 forwardly with respect to vertical member 104. Rotation of handle portion 178 causes first linkage member 182 to rotate in the clockwise direction with respect to handle portion 178, thereby causing engagement portion 180 to move radially outwardly away from the corresponding tire 117 as second linkage member 188 rotates in the clockwise direction relative to first member 104. To engage wheel brake assembly 176, the user simply rotates handle portion 178 in the clockwise direction relative to vertical member 104, thereby causing first linkage member 188 to rotate in the counterclockwise direction relative to handle portion 178, thereby causing engagement portion 188 to make contact with the tire 117.

Figure 4B:
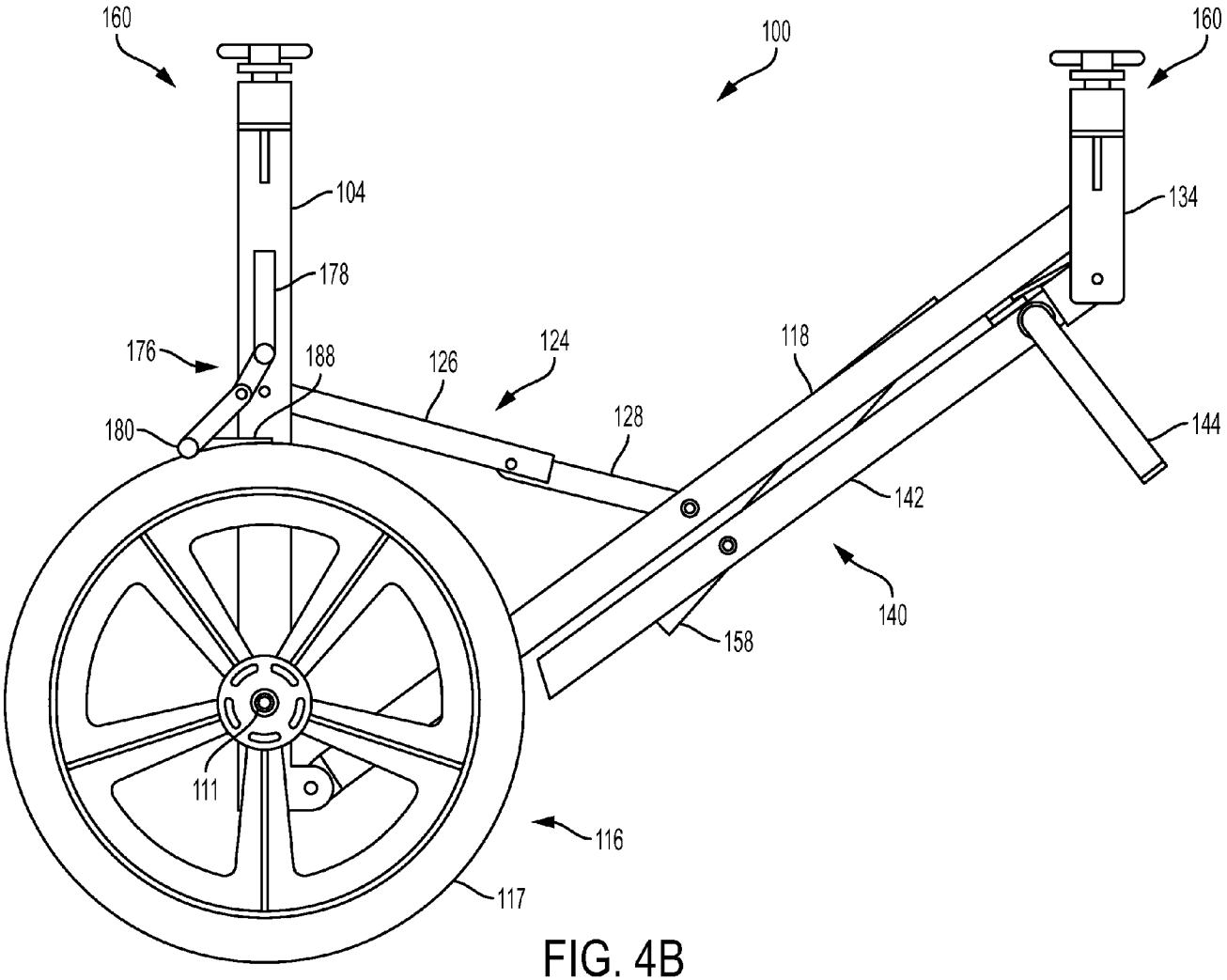
Figure 4C:
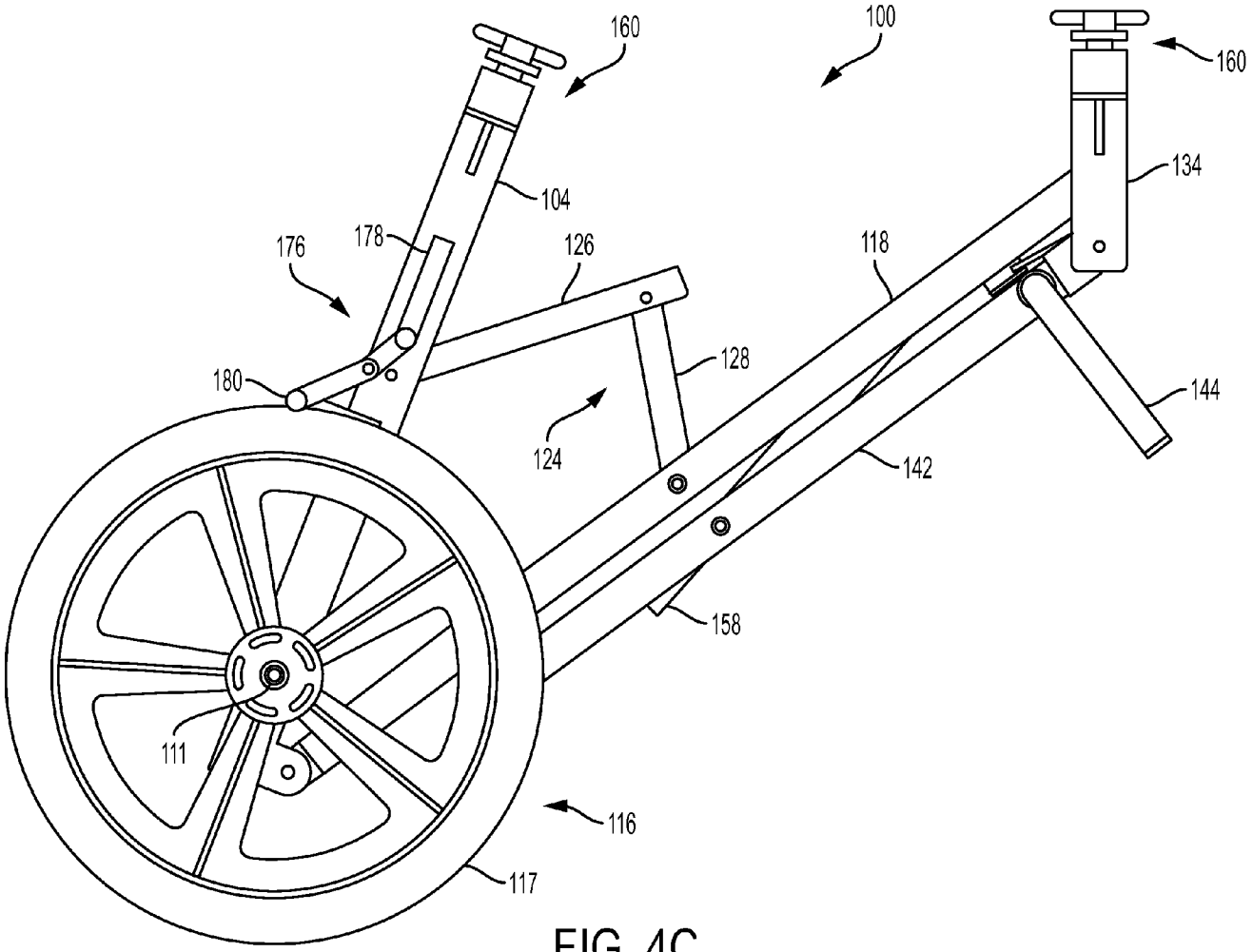
Figure 4D:
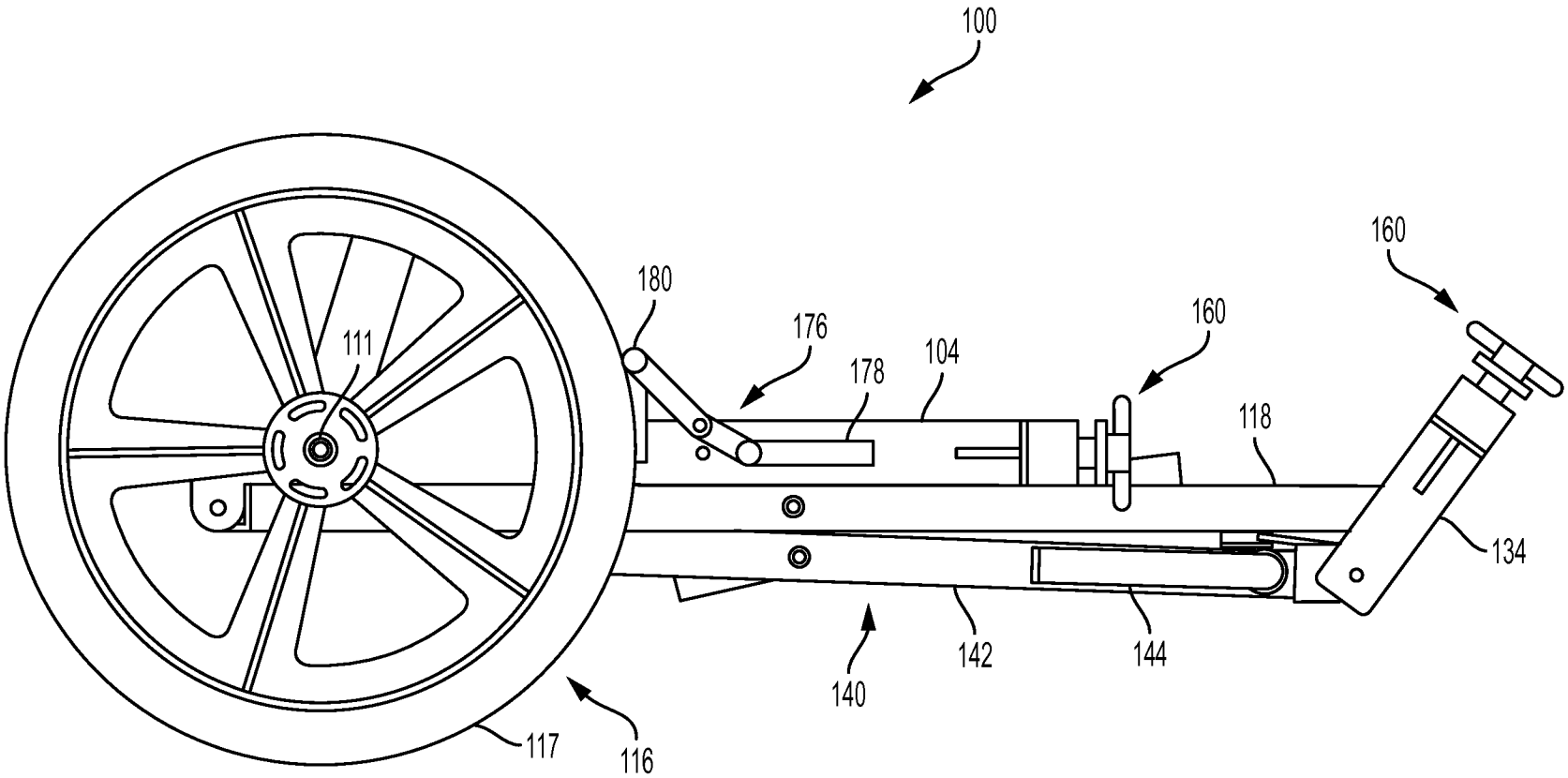

Referring again to FIG. 1, when in use, a stretcher 190 is secured to foldable stretcher trolley 100 by a plurality of clamp assemblies 160 that engage corresponding side rails 192 of the stretcher. Side rails 192 are connected by a plurality of cross members 194 which provide rigidity to the stretcher 190 and also help provide the desired tension on a support surface 196 on which an ambulatory person may be positioned. As shown, when a stretcher is secured to stretcher trolley 100, handles 193 of the stretcher are preferably utilized by the user to maneuver stretcher trolley 100. Alternately, when a stretcher is not secured to stretcher trolley 100, as shown in FIG. 4B, the user may utilize handles 144 of leg assembly 140 to maneuver the stretcher trolley. As shown in FIG. 1, the majority of an attended stretcher 190 is disposed aft of vertical members 104, which are the most forward frame members of frame 102. As such, the majority of the weight of the ambulatory person disposed on stretcher can be expected to be aft of vertical member 104. As such, a single leg assembly 140 secured to the mainframe is adequate to support the stretcher trolley and corresponding stretcher 192 in the upright position, as the patient's center of gravity is disposed aft of vertical member 104. As well, vertical members 104 support a large portion of the supported person's weight due to their vertical orientation as compared to the angled orientation of frame members 118, thereby reducing the stress exerted on their pivoting connection.

Referring now to FIGS. 4A through 4D, a preferred method of folding stretcher trolley 100 is discussed. First, with no stretcher 190 present on the stretcher trolley, a user exerts downward force on foot actuator 158 of second folding strut 152, thereby causing the distal ends of first member 154 and second member 156 to move upwardly as the first and second members pivot inwardly toward each other. As first member 154 and second member 156 of second folding strut 152 pivot inwardly toward each other, legs 142 of leg assembly 140 similarly rotate inwardly toward frame members 118 of foldable frame 102. As previously noted, torsion springs 133 bias leg assembly 140 into the stowed position, shown in FIG. 4B.

Figure 5A:
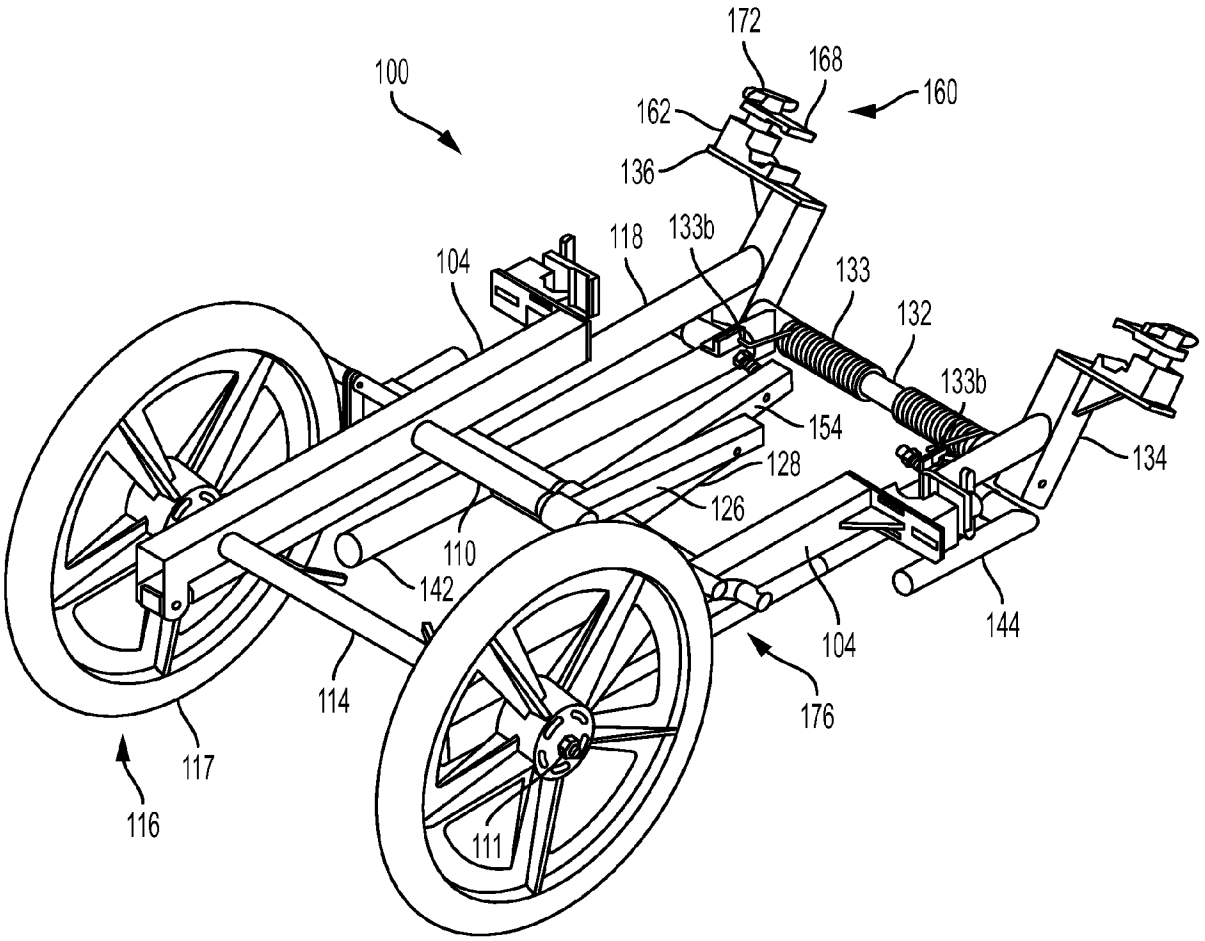
FIGS. 5A and 5B are top perspective views of the foldable stretcher trolley shown in FIG. 1 in the folded position.
Figure 5B:
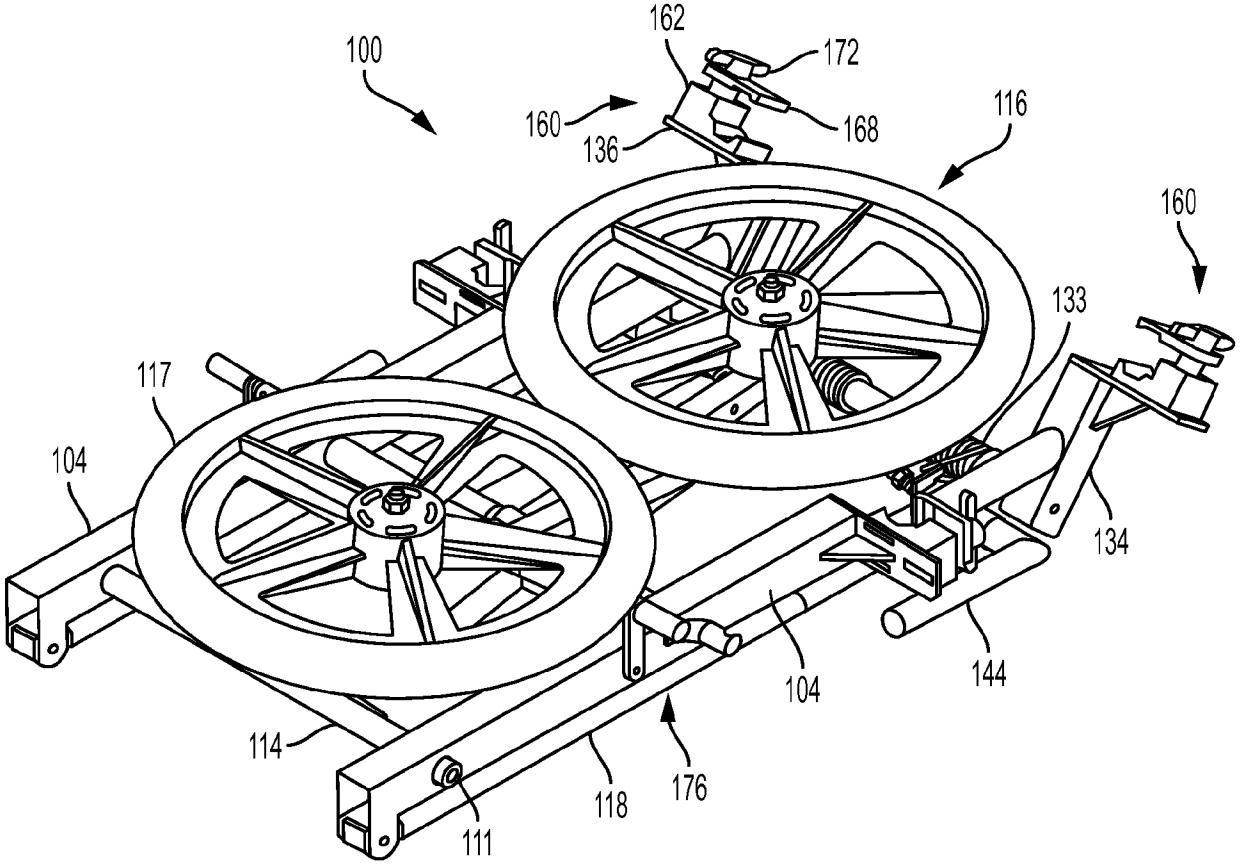

Next, the user exerts upward force on the distal ends of first member 126 and second member 128 of first folding strut 124. As the distal ends move upwardly and the first and second members of first folding strut 124 pivot inwardly toward each other, vertical members 104 similarly pivot inwardly toward frame members 118. Referring additionally to FIG. 5A, stretcher trolley 100 is shown in the fully folded position. Note, however, wheels 116 may also be removed from axle 111 to help further reduce the space required for the storage of stretcher trolley 100.

Referring now to FIGS. 6A through 6E, an alternate embodiment of a clamp assembly 200 for use with stretcher trolley 100 is shown. As shown, clamp assembly 200 includes a base plate 202 mounted to the top end of vertical support 104, a bail 206 including a hook portion 208, and a lever 210 that pivotally connects bail 206 to base plate 202. Proximal end 210*a* of lever 210 is pivotally mounted to base plate 202 at pivot axis 216, whereas bail 206 is pivotally mounted to a central portion of lever 210 at pivot axis 214.

Figure 6A:
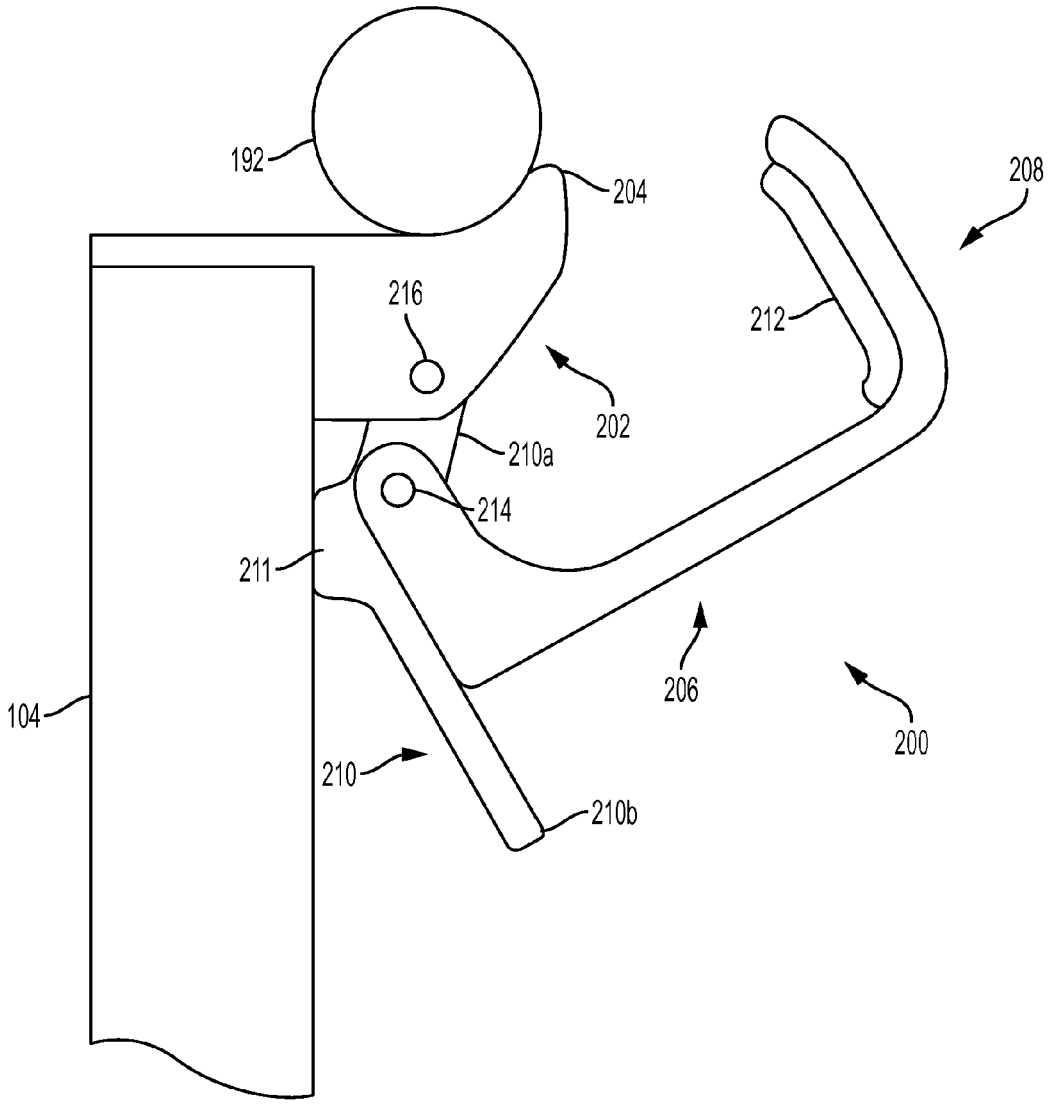
FIGS. 6A through 6E are side and perspective views of an alternate clamp assembly for the foldable stretcher trolley shown in FIG. 1, in various states of being opened and closed.
Figure 6B:
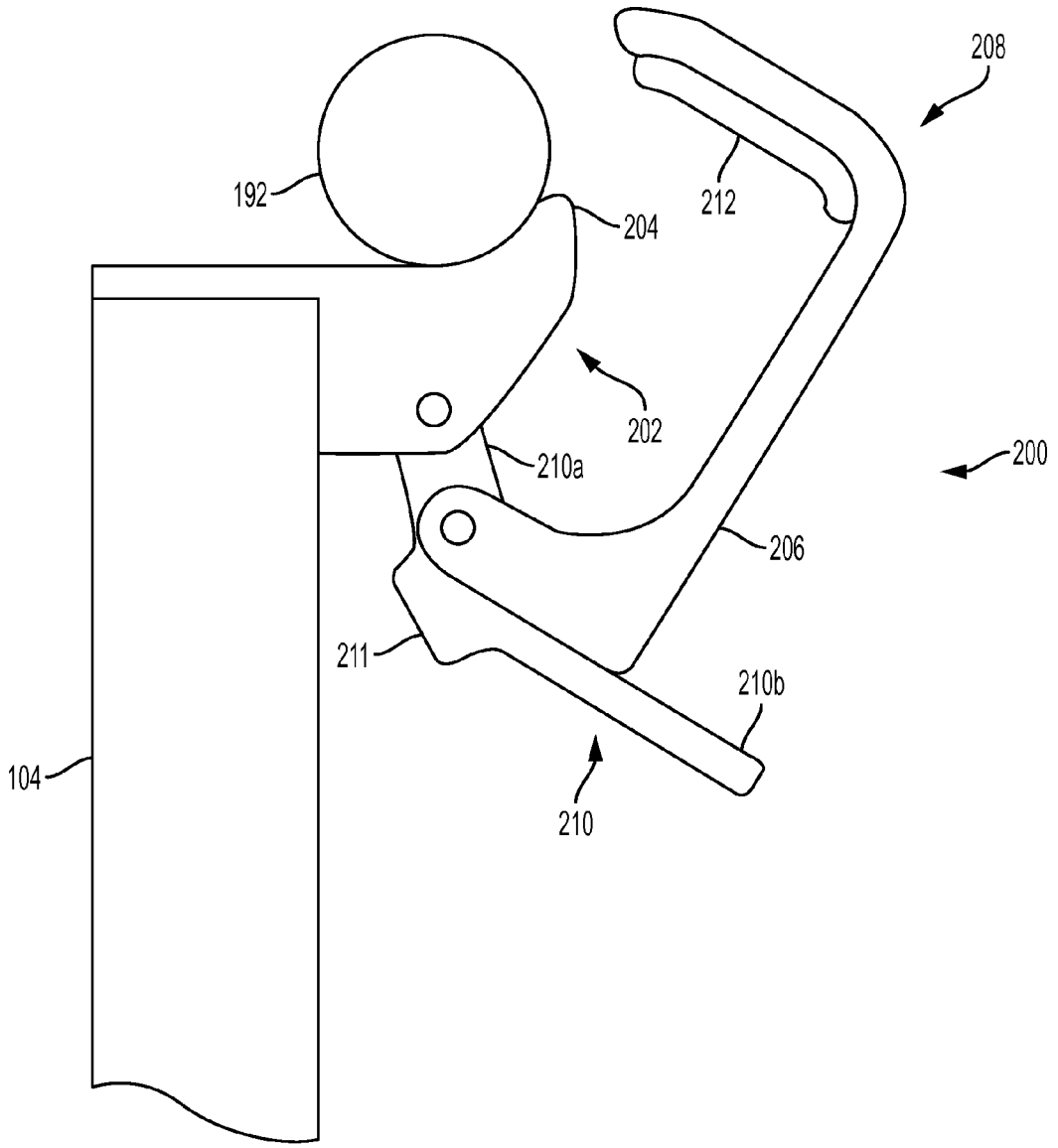
Figure 6C:
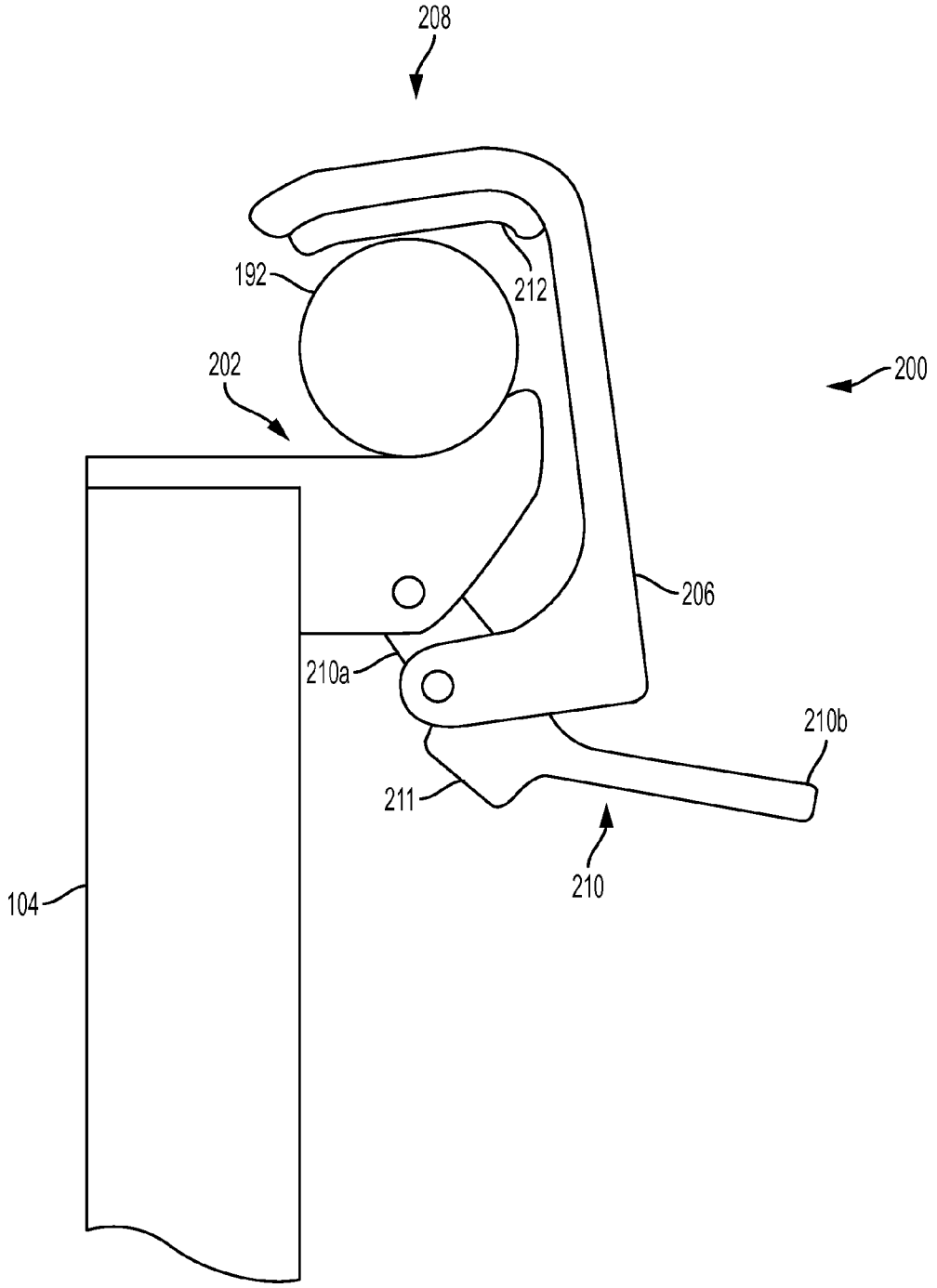
Figure 6D:
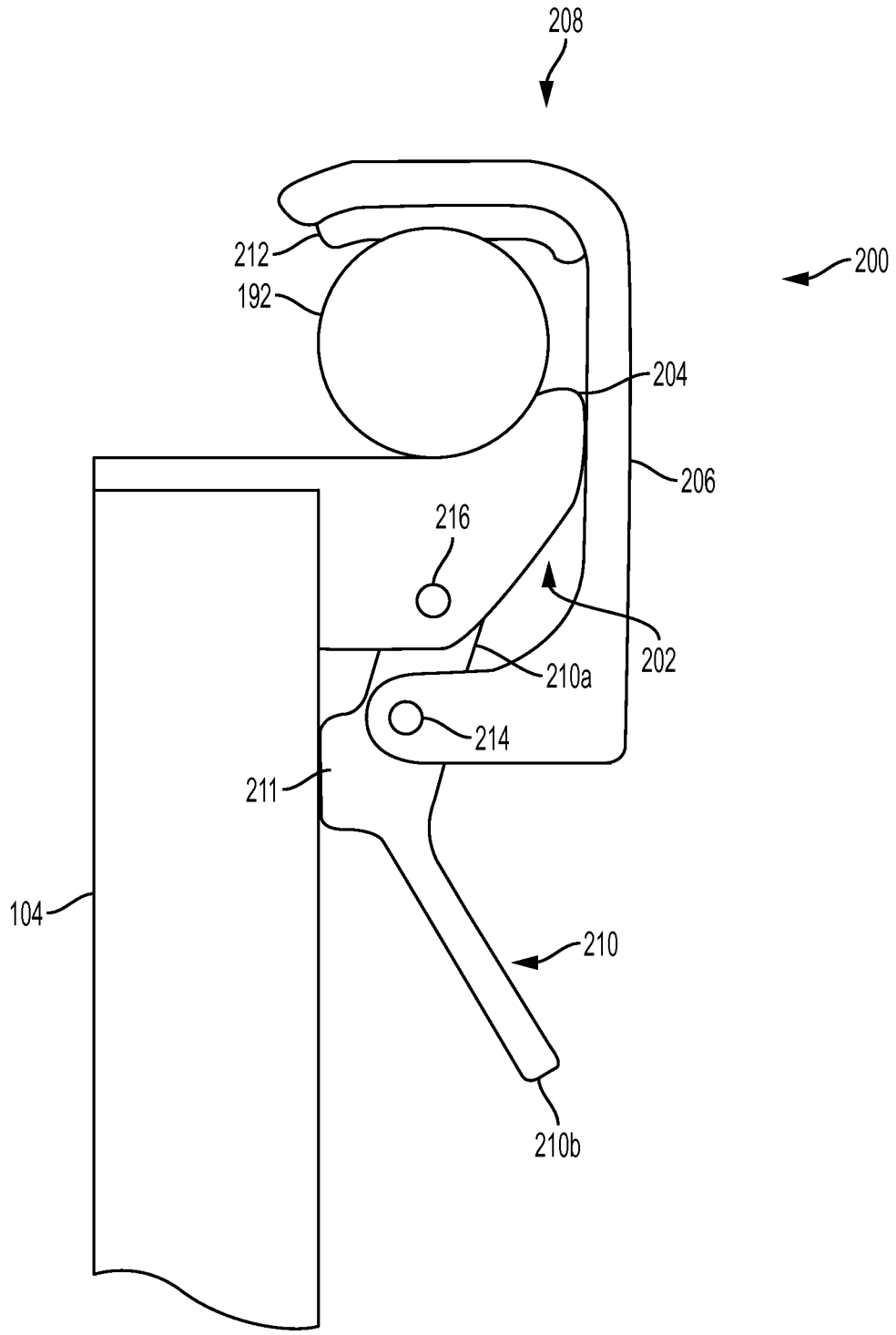
Figure 6E:
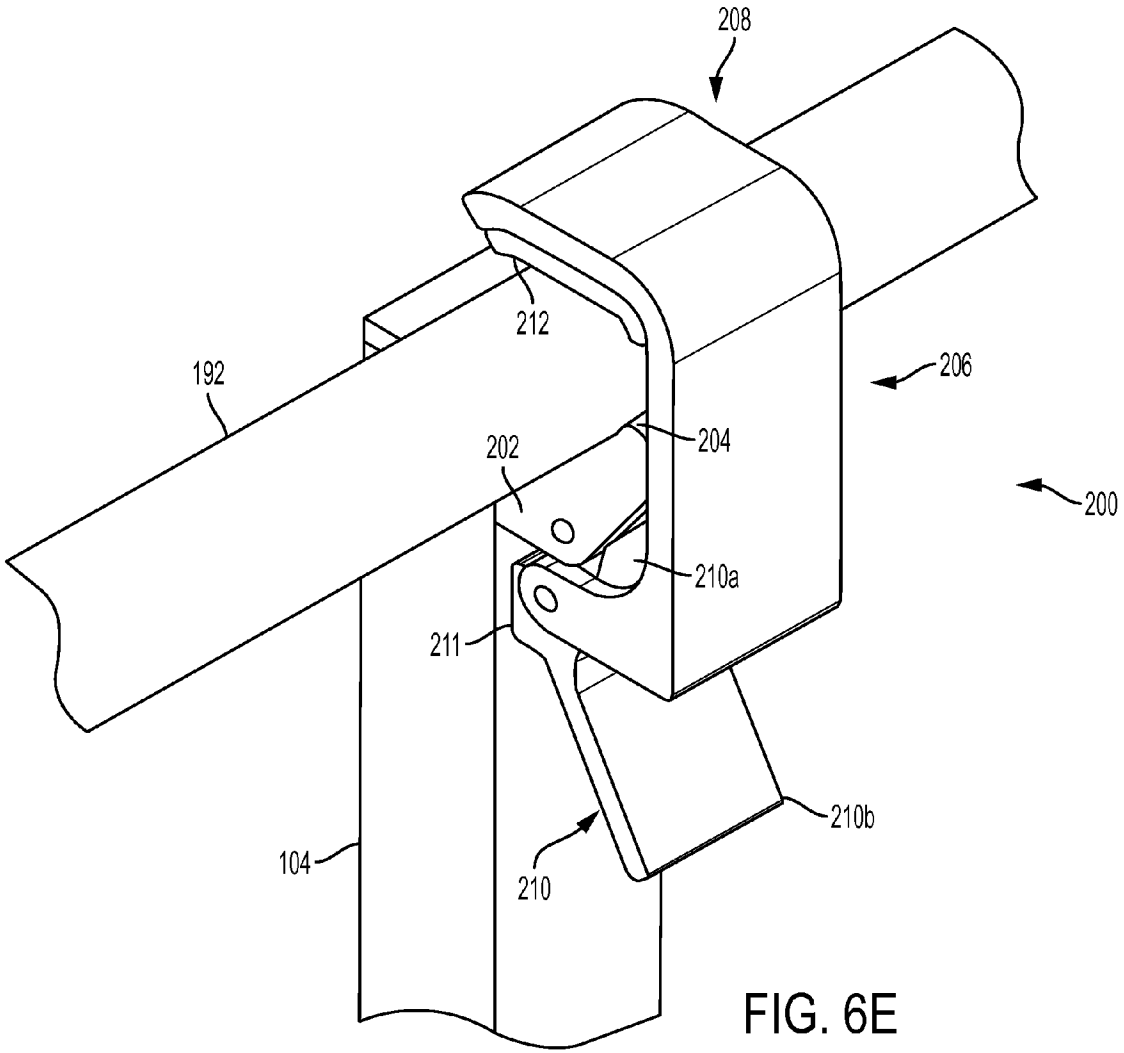

To secure a stretcher 190 (FIG. 1) to stretcher trolley 100, side rails 192 of the stretcher are positioned on base plates 202 of the corresponding clamp assemblies 200. An upwardly depending lip 204 is disposed along the outer edge of each base plate 202 to help prevent the side rails from sliding off of the base plates. With side rails 192 of the stretcher properly positioned, upward pressure is exerted on distal end 210*b* of lever 210 to rotate bail 206, and therefore hook portion 208, above a corresponding side rail 192, as best seen in FIGS. 6B and 6C. When hook portion 208 properly positioned above the corresponding side rail 192, as shown in FIG. 6C, downward force is exerted on distal end 210*b* of lever 210 so that hook portion 208 of bail 206 fully engages the corresponding side rail and exerts downward force thereon, as shown in FIG. 6D. Continued downward force on distal end 210*b* of lever 210 causes bail 206 to further grip side rail, until a contact flange 211 on lever 210 abuts the corresponding vertical member 104 as shown in FIGS. 6D and 6E. Preferably, a grip pad 212 is disposed on the inner surface of hook portion 208 to enhance the gripping force of clamp assembly 200. Moreover, as best seen in FIG. 6D, pivot axis 214 between bail 206 and lever 210 is disposed on the inward side of a pivot axis 216 formed between base plate 202 and lever 210 when the lever is in the closed, or clamped, position. As such, when lever 210 is in the closed position shown in FIG. 6D, it is biased toward the closed position, thereby preventing inadvertent release of hook portion 208.

Figure 7A:
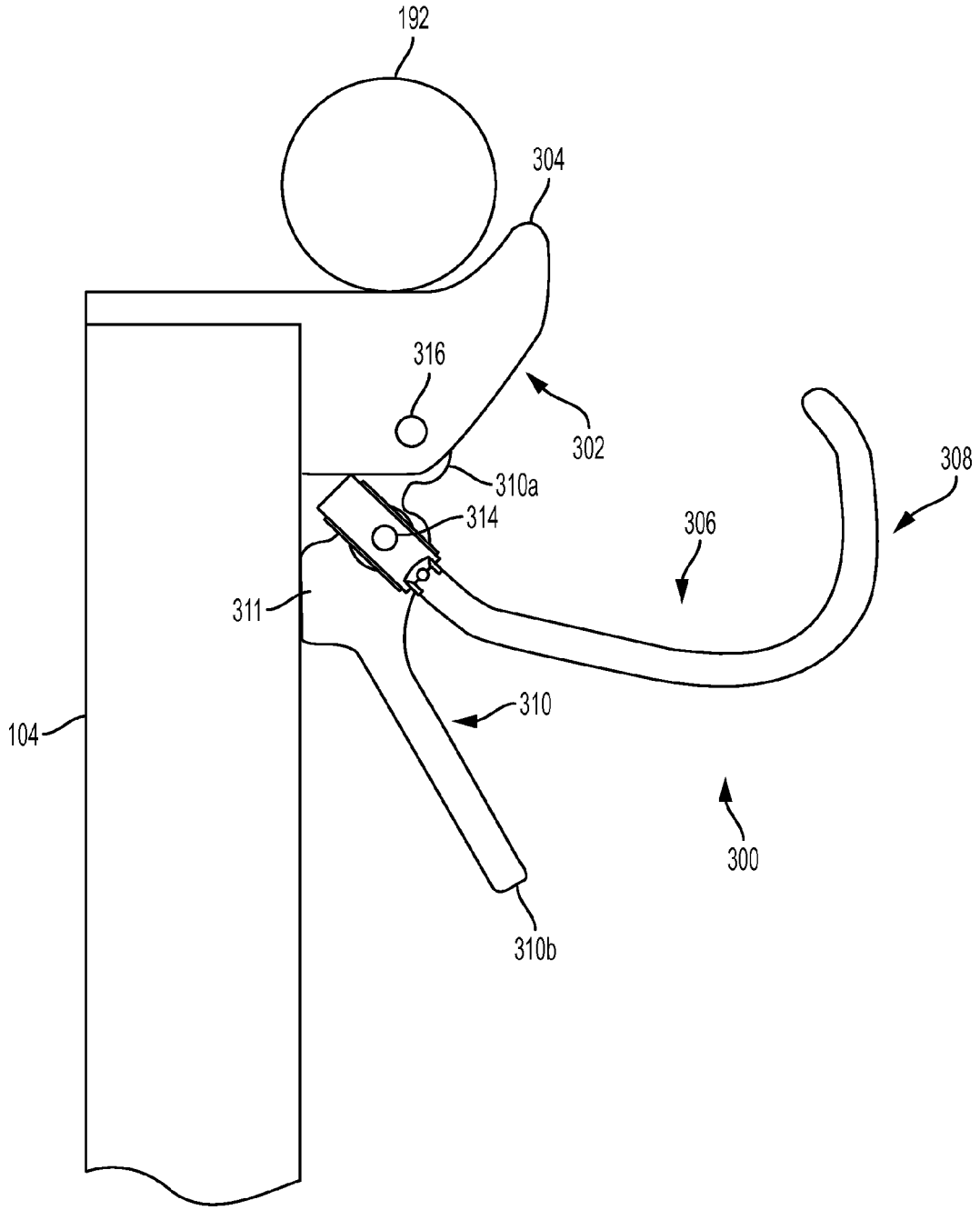
FIGS. 7A through 7E are side and perspective views of an alternate clamp assembly for the foldable stretcher trolley shown in FIG. 1, in various states of being opened and closed.
Figure 7B:
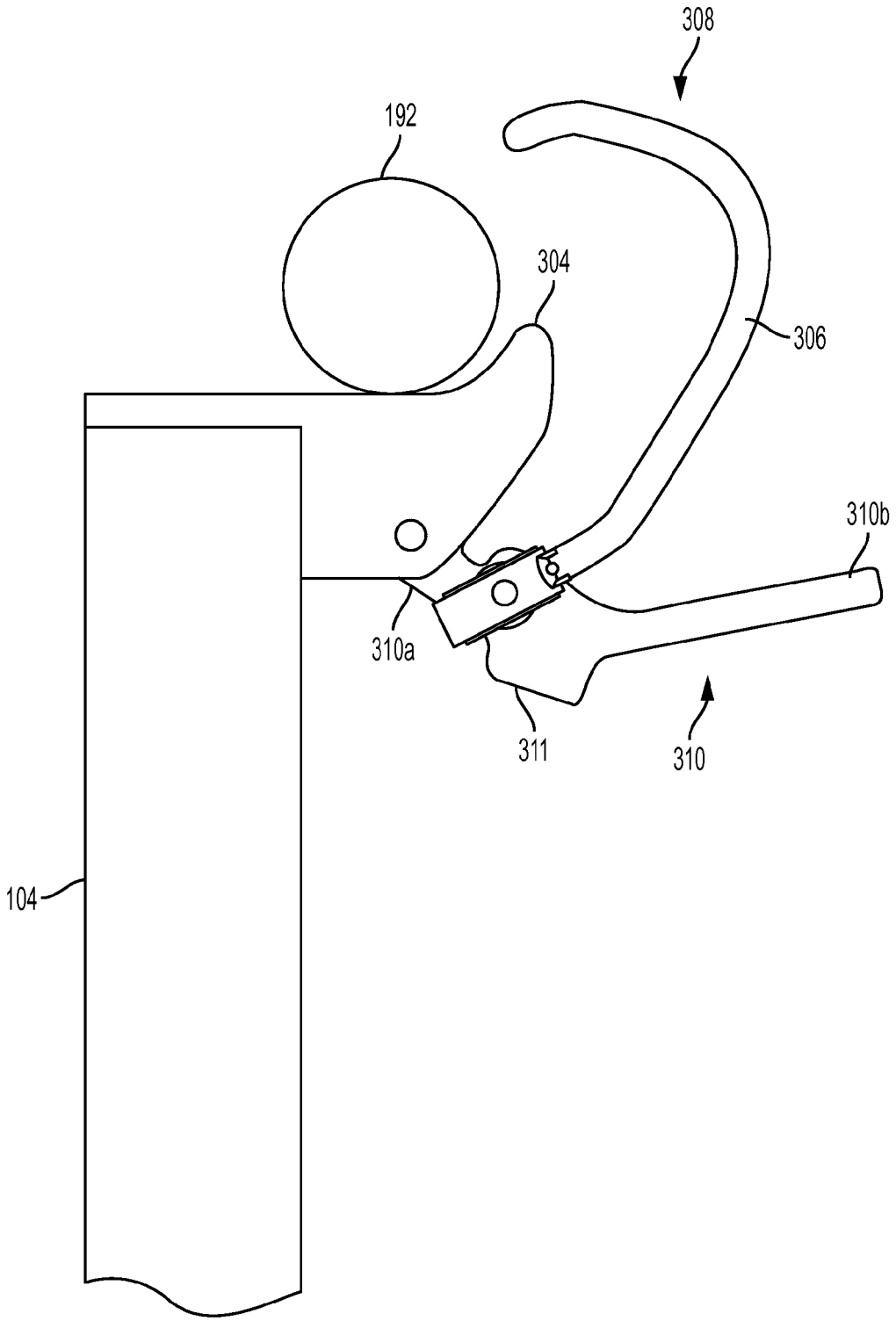
Figure 7C:
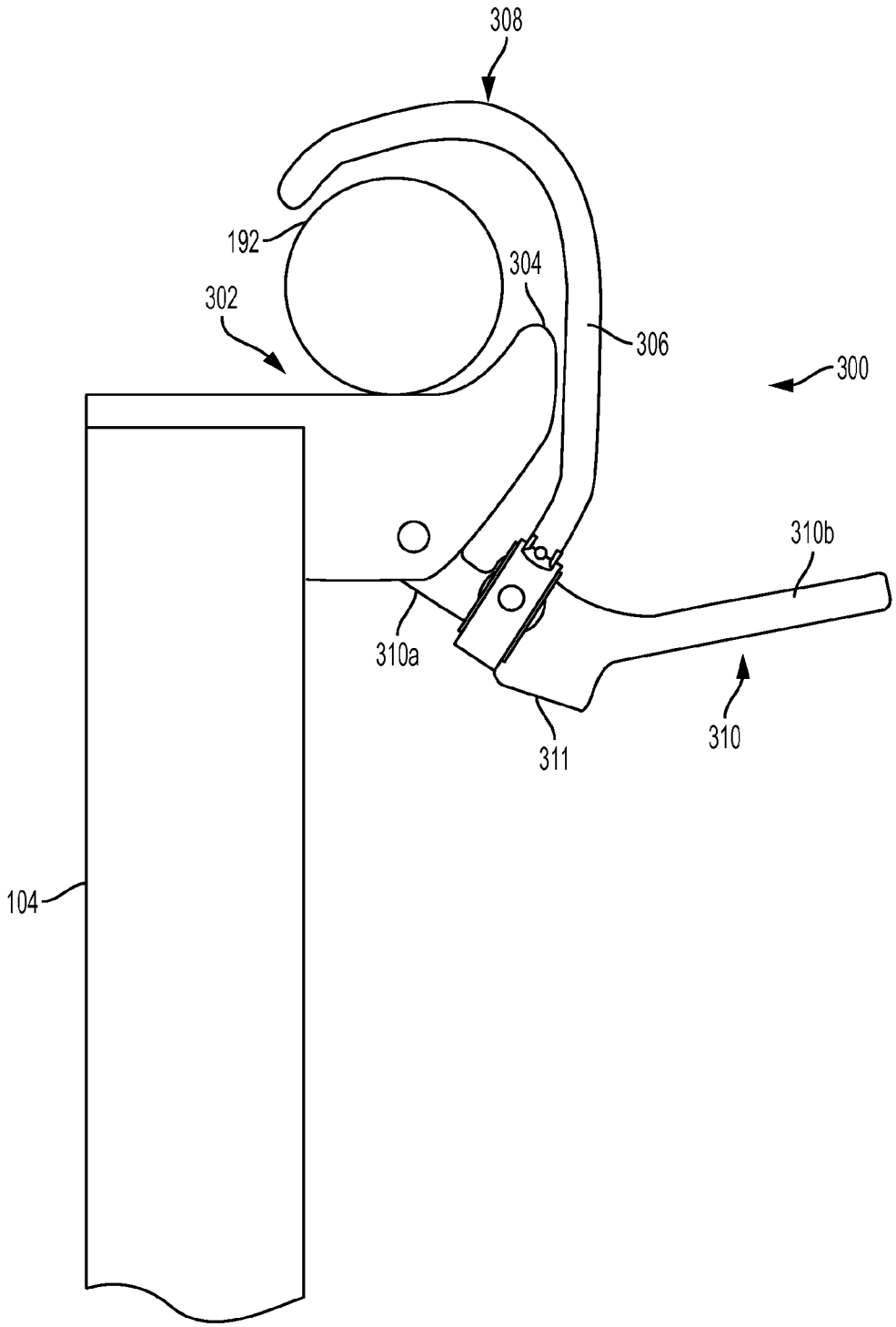
Figure 7D:
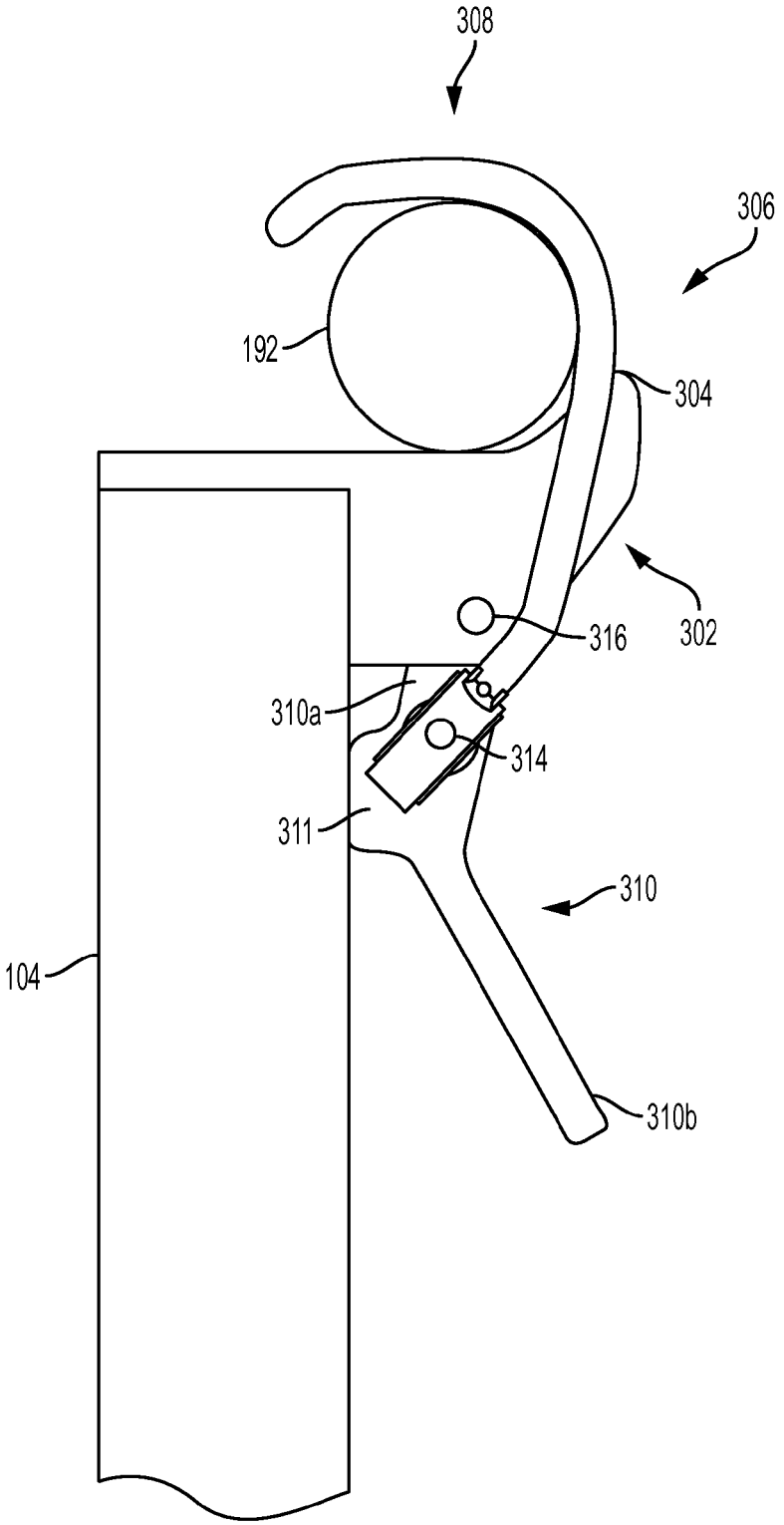
Figure 7E:
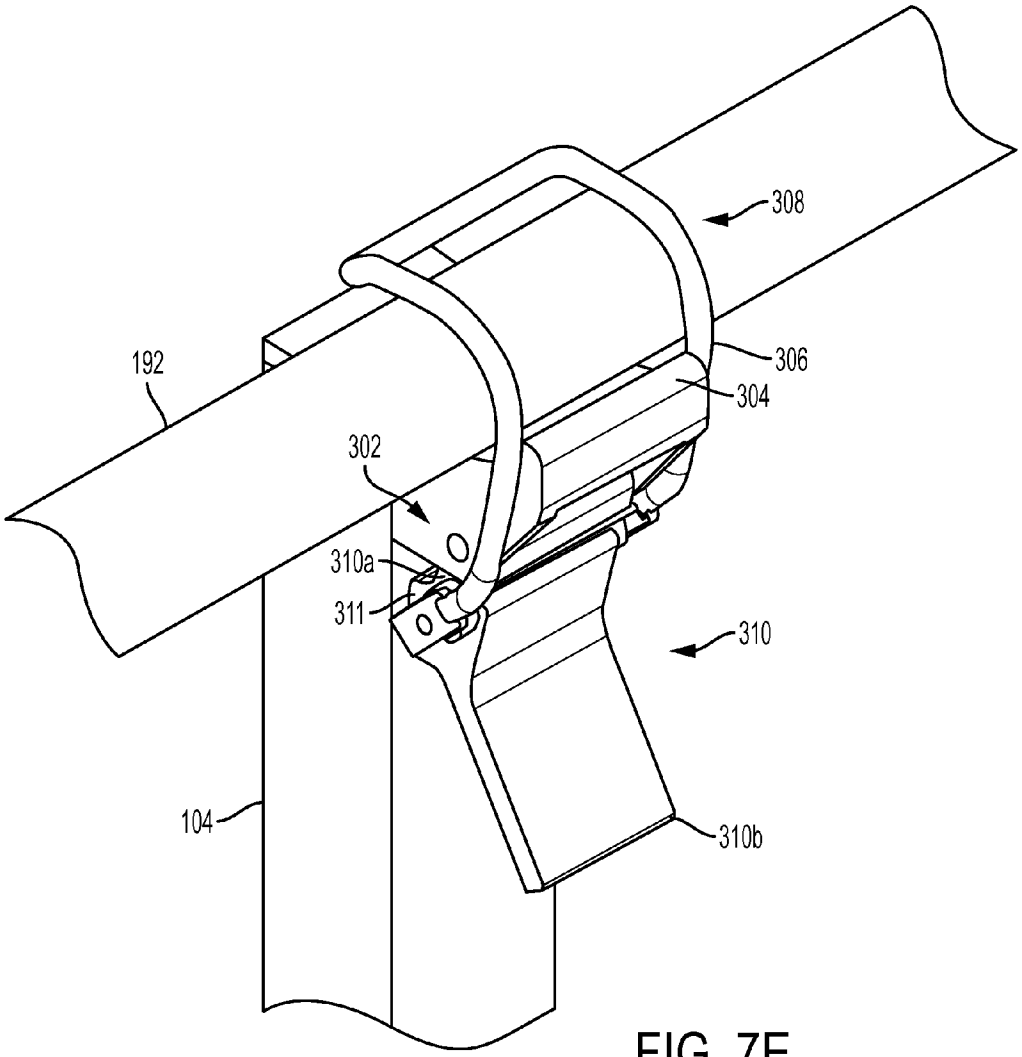

Referring now to FIGS. 7A through 7E, an additional alternate embodiment of a clamp assembly 300 for use with the previously described stretcher trolley 100 is shown. Similarly to the embodiment shown in FIGS. 6A through 6E, clamp assembly 300 includes a base plate 302 with an upwardly depending lip 304, a bail 306 with a hook portion 308, and a lever 310 that pivotally attaches bail 306 to base plate 302. As before, a lever 310 has a proximal end 310*a* that is pivotally connected to base plate 302 at pivot access 316, and bail 306 is pivotally connected to lever 310 at pivot access 314. The present embodiment differs primarily from the embodiment shown in FIGS. 6A through 6E in that its hook portion 308 is formed by heavy gauge wire, as shown in FIG. 7E, rather than being a solid body, as best seen in FIG. 6E. The operation of clamp assembly 300 is the same as that of clamp assembly 200, and therefore the discussion of its operation is not repeated here in the interest of brevity.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

What is claimed is:

1. A foldable trolley for supporting a stretcher, comprising:

a foldable frame including a pair of vertical support members that are rigidly secured to each other by a first horizontal member, and a pair of elongated frame members that are pivotally secured to the pair of vertical support members at their respective bottom ends and rigidly connected by a second horizontal member;

a wheel assembly including a first wheel and a second wheel rotatably attached to a corresponding vertical support member; and a plurality of clamp assemblies, each clamp assembly being mounted to a top end of each vertical support member and each elongated frame members, each clamp assembly being movable between a closed position to engage the stretcher and an open position to disengage the stretcher, wherein the foldable frame is adjustable between an in-use position in which the pair of elongated frame members extend both rearwardly and upwardly from the bottom ends of the vertical support members, thereby forming an acute angle therebetween, to a stored position in which the pair of elongated frame members is substantially parallel to the pair of vertical support members.

2. The foldable trolley of claim 1, further comprising:

a first folding strut having a first member that is pivotally secured to the first horizontal member at its proximal end, and a second member that is pivotally secured to second horizontal member, wherein a distal end of the first member is pivotally attached to a distal end of the second member, wherein the first folding strut is movable from an extended position in which the first member and the second member are axially aligned, thereby maintaining the foldable frame in the in-use position, to the stored position in which the pair of elongated frame members is substantially parallel to the pair of vertical support members.

3. The foldable trolley of claim 2, further comprising a leg assembly including a pair of elongated legs that are rigidly connected to each other by a third horizontal member and pivotally secured to the top ends of the pair or elongated frame members, wherein the leg assembly is pivotal between an in-use position in which the elongated legs extend rearwardly from the elongated frame members and a stored position in which the elongated legs are substantially parallel with the elongated frame members.

4. The foldable trolley of claim 3, further comprising:

a second folding strut having a first member that is pivotally secured to the second horizontal member at its proximal end, and a second member that is pivotally secured to the third horizontal member, wherein a distal end of the first member is pivotally attached to a distal end of the second member, wherein the second folding strut is movable from an extended position in which the first member and the second member are axially aligned, thereby maintaining the leg assembly in the in-use position, to a folded position in which the pair of elongated legs is substantially parallel to the pair of elongated frame members and the leg assembly is in the stored position.

5. The foldable trolley of claim 4, wherein the second member of the second folding strut further comprises a first elongated portion that is pivotally connected to the first member of the second folding strut, a sleeve that is rotatably disposed about the third horizontal member, and a second elongated portion, wherein the first elongated portion and the second elongated portion extend radially outwardly from the sleeve opposite each other.

6. The foldable trolley of claim 5, further comprising a coil spring having a first end fixed to the fourth horizontal member and a second end fixed to the leg assembly, wherein the coil spring is disposed about the fourth horizontal member and biases the leg assembly from the in-use position to the stored position.

7. The foldable trolley of claim 4, further comprising a fourth horizontal member that rigidly connects the top ends of the elongated frame members.

8. The foldable trolley of claim 1, wherein each clamp assembly includes a base plate fixed to one of the top ends of the vertical support members and the elongated frame members, and a top plate that is pivotally secured to the base plate by a threaded bolt, wherein the threaded bolt is movable between a clamping position in which the top plate is non-rotatably fixed to the base plate and a release position in which the top plate is pivotal with respect to the base plate.

9. The foldable trolley of claim 1, wherein each clamp assembly includes a base plate fixed to one of the top ends of the vertical support members and the elongated frame members, a lever pivotally secured to the base plate, and a bail that is pivotally secured to the lever, wherein the lever is pivotal relative to the base plate between a clamping position in which the bail exerts downward force or a corresponding portion of the stretcher that is disposed between the bail and the base plate, and a release position in which the bail is pivotal away from the corresponding portion of the stretcher.

10. A foldable trolley and stretcher assembly, comprising:

a stretcher including a pair of side rails and a support surface extending therebetween;

a foldable frame including a pair of vertical support members that are rigidly secured to each other by a first horizontal member, and a pair of elongated frame members that are pivotally secured to the pair of vertical support members at their respective bottom ends and rigidly connected by a second horizontal member;

a wheel assembly including a first wheel and a second wheel rotatably attached to a corresponding vertical support member; and a plurality of clamp assemblies, each clamp assembly being mounted to a top end of each vertical support member and each elongated frame members, each clamp assembly being movable between a closed position to engage the stretcher and an open position to disengage the stretcher, wherein the foldable frame is adjustable between an in-use position in which the pair of elongated frame members form an acute angle with the vertical support members, to a stored position in which the pair of elongated frame members is substantially parallel to the pair of vertical support members, and the vertical support members are transverse to the corresponding side rails of the stretcher when the stretcher is secured to the foldable frame by the plurality of clamp assemblies.

11. The foldable trolley and stretcher assembly of claim 10, further comprising:

a first folding strut having a first member that is pivotally secured to the first horizontal member at its proximal end, and a second member that is pivotally secured to second horizontal member, wherein a distal end of the first member is pivotally attached to a distal end of the second member, wherein the first folding strut is movable from an extended position in which the first member and the second member are axially aligned, thereby maintaining the foldable frame in the in-use position, to the stored position in which the pair of elongated frame members is substantially parallel to the pair of vertical support members.

12. The foldable trolley and stretcher assembly of claim 11, further comprising a leg assembly including a pair of elongated legs that are rigidly connected to each other by a third horizontal member and pivotally secured to the top ends of the pair or elongated frame members, wherein the leg assembly is pivotal between an in-use position in which the elongated legs extend rearwardly from the elongated frame members and a stored position in which the elongated legs are substantially parallel with the elongated frame members.

13. The foldable trolley and stretcher assembly of claim 12, further comprising:

a second folding strut having a first member that is pivotally secured to the second horizontal member at its proximal end, and a second member that is pivotally secured to the third horizontal member, wherein a distal end of the first member is pivotally attached to a distal end of the second member, wherein the second folding strut is movable from an extended position in which the first member and the second member are axially aligned, thereby maintaining the leg assembly in the in-use position, to a folded position in which the pair of elongated legs is substantially parallel to the pair of elongated frame members and the leg assembly is in the stored position.

14. The foldable trolley and stretcher assembly of claim 13, wherein the second member of the second folding strut further comprises a first elongated portion that is pivotally connected to the first member of the second folding strut, a sleeve that is rotatably disposed about the third horizontal member, and a second elongated portion, wherein the first elongated portion and the second elongated portion extend radially outwardly from the sleeve opposite each other.

15. The foldable trolley and stretcher assembly of claim 13, further comprising a fourth horizontal member that rigidly connects the top ends of the elongated frame members.

16. The foldable trolley and stretcher assembly of claim 15, further comprising a coil spring having a first end fixed to the fourth horizontal member and a second end fixed to the leg assembly, wherein the coil spring is disposed about the fourth horizontal member and biases the leg assembly from the in-use position to the stored position.

17. The foldable trolley and stretcher assembly of claim 10, wherein each clamp assembly includes a base plate fixed to one of the top ends of the vertical support members and the elongated frame members, and a top plate that is pivotally secured to the base plate by a threaded bolt, wherein the threaded bolt is movable between a clamping position in which the top plate is non-rotatably fixed to the base plate and a release position in which the top plate is pivotal with respect to the base plate.

18. The foldable trolley and stretcher assembly of claim 10, wherein each clamp assembly includes a base plate fixed to one of the top ends of the vertical support members and the elongated frame members, a lever pivotally secured to the base plate, and a bail that is pivotally secured to the lever, wherein the lever is pivotal relative to the base plate between a clamping position in which the bail exerts downward force or a corresponding portion of the stretcher that is disposed between the bail and the base plate, and a release position in which the bail is pivotal away from the corresponding portion of the stretcher.

* * * * *